US008459059B2

(12) United States Patent
Benigni et al.

(10) Patent No.: US 8,459,059 B2
(45) Date of Patent: Jun. 11, 2013

(54) REFRIGERATOR UNIT AND/OR FREEZER UNIT

(75) Inventors: Karl Benigni, Oberdrauburg (AT); Florian Oberhauser, Assling (AT); Manfred Gradl, Oberdrauburg (AT)

(73) Assignee: Liebherr-Hausgeräte Lienz GmbH, Lienz (AT)

( * ) Notice: Subject to any disclaimer, the term of this patent is extended or adjusted under 35 U.S.C. 154(b) by 534 days.

(21) Appl. No.: 12/319,798

(22) Filed: Jan. 12, 2009

(65) Prior Publication Data

US 2009/0217695 A1 Sep. 3, 2009

(30) Foreign Application Priority Data

Jan. 16, 2008 (DE) ..... 20 2008 000 634 U

(51) Int. Cl.
*F24F 1/01* (2006.01)
*F25D 17/04* (2006.01)
*F25B 39/04* (2006.01)

(52) U.S. Cl.
USPC ..... 62/507; 62/186; 165/123

(58) Field of Classification Search
USPC ..... 62/186, 454, 456, 452, 506, 507
See application file for complete search history.

(56) References Cited

U.S. PATENT DOCUMENTS

| | | | | | |
|---|---|---|---|---|---|
| 1,769,111 | A | * | 7/1930 | Davenport | 62/455 |
| 2,310,089 | A | * | 2/1943 | Hudson | 194/219 |
| 2,318,893 | A | * | 5/1943 | Smith | 165/249 |
| 2,332,730 | A | * | 10/1943 | Kucher | 62/179 |
| 2,476,018 | A | * | 7/1949 | Young et al. | 165/236 |
| 2,908,147 | A | * | 10/1959 | Powers | 62/186 |
| 3,079,770 | A | * | 3/1963 | Brown et al. | 62/455 |
| 3,306,066 | A | * | 2/1967 | Takada et al. | 62/183 |
| 4,370,863 | A | * | 2/1983 | Fisher | 62/89 |
| 6,637,227 | B2 | * | 10/2003 | Stensrud et al. | 62/217 |
| 6,694,769 | B2 | * | 2/2004 | Pelleter et al. | 62/324.1 |

FOREIGN PATENT DOCUMENTS

| | | | |
|---|---|---|---|
| DE | 2458981 | | 6/1976 |
| EP | 0568809 | | 11/1993 |
| EP | 1384963 | | 1/2004 |
| JP | 06-294570 | | 10/1994 |
| JP | 11-230661 | | 8/1999 |
| JP | 11230661 | A * | 8/1999 |
| KR | 20010090913 | A | 10/2001 |
| WO | 2008/000811 | | 1/2008 |

* cited by examiner

*Primary Examiner* — Allen Flanigan
*Assistant Examiner* — Jason Thompson
(74) *Attorney, Agent, or Firm* — Dilworth & Barrese, LLP.

(57) ABSTRACT

The present invention relates to a refrigerator unit and/or a freezer unit comprising at least one fan, at least one compressor and at least one condenser, wherein the fan is arranged such that it applies air to the compressor and to the condenser in parallel.

14 Claims, 1 Drawing Sheet

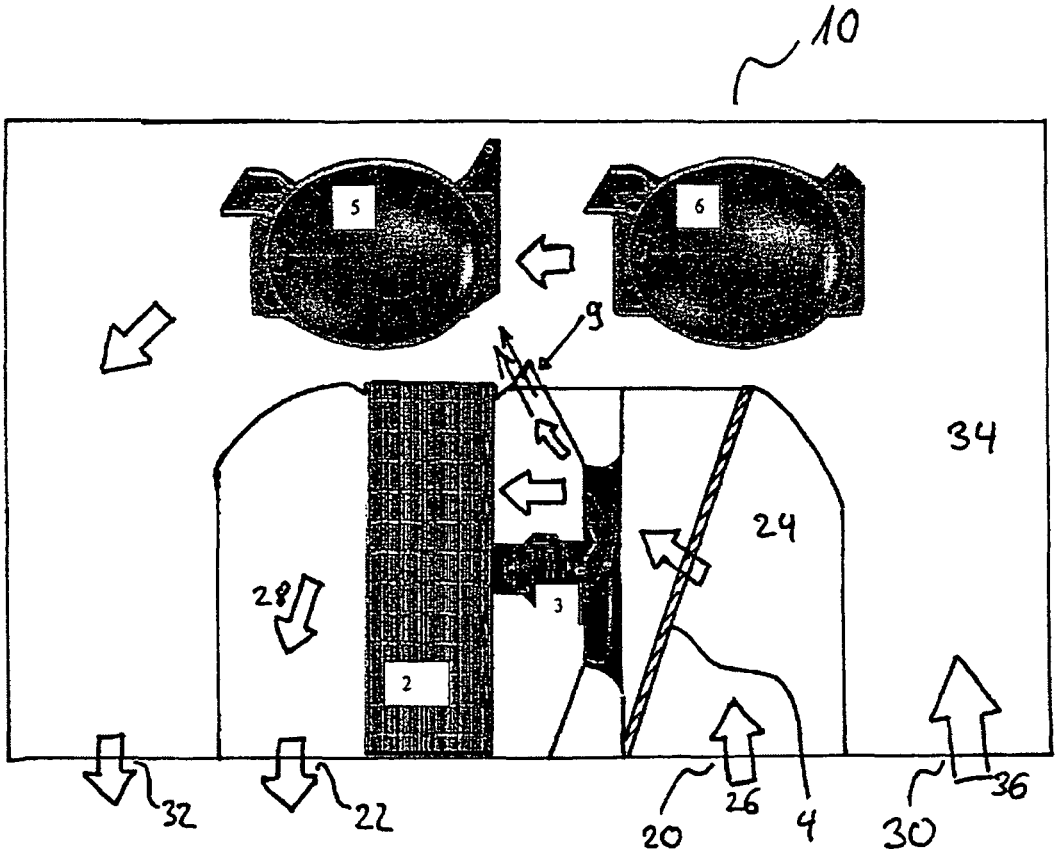
10
5
6
9
34
24
28
3
2
32
22
20
26
4
30
36

REFRIGERATOR UNIT AND/OR FREEZER UNIT

BACKGROUND OF THE INVENTION

The present invention relates to a refrigerator unit and/or a freezer unit comprising at least one fan, at least one compressor and at least one condenser.

With such refrigerator units and/or freezer units, in particular in the version with a base assembly or a top assembly, the fan, condenser and compressor(s) are connected in series. The arrangement can be variable in this respect, e.g. in the form of a series connection of compressor, fan and condenser or in the form of a series connection of condenser, fan and compressor.

The first variant has the disadvantage that the emitted compressor heat is supplied to the condenser by means of the fan, whereas in the second variant the emitted condenser heat is supplied to the compressor. These embodiments known from the prior art, as described with reference to the two examples, thus have the disadvantage that the waste heat of one or more components is conducted to a further component which is likewise to be cooled.

SUMMARY OF THE INVENTION

It is therefore the object of the present invention to further develop a refrigerator unit and/or a freezer unit of the initially named kind such that it overcomes the disadvantages known from the prior art.

The object is solved by a refrigerator unit and/or a freezer unit having the features herein. Provision is accordingly made that a refrigerator unit and/or a freezer unit has at least one fan, at least one compressor and at least one condenser, with the fan or fans being arranged such that they apply air to the compressor and condenser in parallel. The advantage thereby results that an application to one of the components of the waste heat of the other component(s) is effectively avoided, with the use of one fan being sufficient. Generally, a plurality of fans can also be used of which at least one applies cooling air to the condenser or condensers and at least one applies cooling air to the compressor or compressors.

It is conceivable that the compressor and condenser are acted on by means of ambient air. The advantage thereby results that the temperature difference of the components to be cooled to the environment can be utilized for the dissipation of heat.

Provision can be made that the fan, the compressor and the condenser are made or arranged as a base assembly or as a top assembly. It in particular proves an advantage with such units due to the available space to be able to apply cooling air to both compressor(s) and condenser(s) by means of one fan.

One or more filters can be provided in front of the fan. The advantage thereby results that the contamination of e.g. the condenser can be prevented/reduced. This in turn contributes to maintaining the full performance of the condenser and thus helps to increase the efficiency of the refrigerator unit and/or freezer unit.

Provision can moreover be made that the compressor and the condenser are arranged at least partly partitioned from one another with respect to the airflow guidance. An improved or direct airflow guidance can be achieved by partitions.

It can furthermore be imagined that an air guidance device is provided which separates the airflow from or to the compressor and from or to the condenser from one another at least partly. Such an air guidance device can in this respect also already have corresponding cut-outs or mounts for the compressors, the fan or the condenser.

It is possible that the air guidance device has an airflow guidance for the compressor and an airflow guidance for the condenser as well as at least one bypass passage or connection passage which connects the two airflow guidances with one another. The distribution of the airflow used for cooling can be set directly via such a connection passage.

The fan and/or at least one compressor can be arranged downstream of the fan. It is generally equally conceivable to arrange one or more of the components to be cooled upstream of the fan.

Provision is made in an advantageous embodiment that the bypass passage or connection passage is arranged downstream of the fan. Some of the airflow can thereby be diverted in a particularly simple manner for application to the further components, e.g. to the compressors.

A further embodiment possibility comprises the airflow guidances each having an inlet and an outlet which are arranged such that the airflow takes place in parallel through the inlets and through the outlets.

It is of advantage if the inlets and the outlets are arranged such that the airflow from the inlets and to the outlets sweeps over a curved region, for example an angular region of 180°. Other cooling regions, such as the air guidance by 90°, etc. are also conceivable. An improved space utilization thereby results, which is in particular advantageous in an embodiment with a base assembly or a top assembly.

It is particularly advantageous if the inlets and the outlets are arranged such that the airflow over the compressor takes place on an outer path and the airflow guidance over the condenser takes place on an inner path. A converse arrangement is also possible. The possibility thereby results of setting the cooling capacity by the thereby arising different throughput volumes and of coordinating it accordingly with the requirements of the condenser or of the compressors.

Provision can furthermore be made that the bypass passage or connection passage has an actuator for the throughput setting. The distribution of the airflow can be varied with the help of this actuator, for example manually or automatically, optionally in dependence on the actual cooling air requirement, since the airflow diverted via the bypass passage or communication passage can be set.

BRIEF DESCRIPTION OF THE DRAWING

Further details and advantages of the invention will be explained in more detail with reference to an embodiment described in the drawing.

DESCRIPTION OF THE PREFERRED EMBODIMENT

The only FIGURE schematically shows in this respect the base of a refrigerator and freezer unit in accordance with the invention with a base assembly which has an air guidance device 10. Inlet openings 20 and 30 as well as outlet openings 22 and 32 are provided at the end face shown at the bottom. In this respect, the inlet opening and the outlet opening 20 and 22 belong to the airflow guidance 24 of the condenser 2, whereas the inlet opening and the outlet opening 30 and 32 belong to the airflow guidance 34 of the compressors 5 and 6.

A filter 4 is attached downstream of the inlet opening 20 to reduce or prevent the contamination of the condenser 2 and to maintain the performance. The total cool ambient air entering through the inlet opening 20 is cleaned, in particular from dust, by the filter 4. The filter is arranged obliquely to the inlet direction and upstream of the fan 3 in this respect to provide a filter surface which is as large as possible. This permits a longer service life of the filter 4.

The fan 3 which applies cool ambient air 26 to the condenser 2 using a primary airflow and which sucks it off via the inlet opening 20 is attached downstream of the filter 4. The air 28 emerges again via the outlet opening 22 without being guided over the compressors 5 and 6.

Some of the sucked in primary airflow is led off to the airflow guidance 34 of the compressors 5 and 6 via the bypass passage 9 which is diverted from the airflow guidance 24 downstream of the fan 3. The cool ambient air from the primary airflow is thus also guided to the compressor 5 and then emerges again in heated form via the outlet opening 32. A secondary airflow 36 thereby arises in the airflow guidance 34 which emerges without drive by a separate fan arranged in the airflow guidance 34. This secondary airflow 36 enters as cool ambient air through the inlet opening 30 and is applied to the compressors 5 and 6. The air entering into the airflow guidance 34 through the bypass passage 9 effects an air movement therein so that a cooling airflow is also applied to the compressor 6 arranged upstream of the bypass passage 9.

It is achieved in accordance with the invention that the compressors 5 and 6, on the one hand, and the condenser 2, on the other hand, do not influence one another by their waste heat since the waste heat which arises is respectively dissipated separately.

The air guidances 24 and 34 guide the air by 180° so that the inlet direction and outlet direction of the airflow extend in parallel. The airflow guidance 24 of the condenser 2 lies on the inner path in this respect. Generally, two or also more than two airflow guidances or paths can be provided on which one more components to be cooled are located. A compact airflow guidance is thereby made possible.

The invention claimed is:

1. A refrigerator unit and/or a freezer unit comprising at least a fan (3), at least one compressor (5, 6) and at least one condenser (2), wherein the compressor (5, 6) and condenser (2) are arranged in parallel with respect to one another and in separate channels (24, 34) from one another such that application of waste heat from one of the compressor (5, 6) or the condenser (2) to the other of the compressor (5, 6) or the condenser (2) is avoided, the fan (3) is arranged to supply an air flow to the compressor (5, 6) and condenser (2) separately from one another and in parallel, at least one bypass passage (9) is arranged downstream of the fan (3), said bypass passage (9) connecting both channels (24, 34) with one another, the fan (3) is located in one (24) of the separate channels (24, 34) to provide a primary airflow in the respective channel (24), and a secondary airflow is induced in the other (34) of the separate channels (24, 34) by air passing through the bypass passage (9) without drive by a separate fan.

2. The refrigerator unit and/or freezer unit in accordance with claim 1, wherein the compressor (5, 6) and the condenser (2) are acted on by ambient air.

3. The refrigerator unit and/or freezer unit in accordance with claim 1, wherein the fan (3), the compressor (5, 6) and the condenser (2) are arranged as base assemblies or as top assemblies.

4. The refrigerator unit and/or freezer unit in accordance with claim 1, wherein one or more filters (4) are provided in front of the fan (3).

5. The refrigerator unit and/or freezer unit in accordance with claim 1, wherein the condenser (2) and/or at least one compressor (5, 6) is arranged downstream of the fan (3).

6. The refrigerator unit and/or freezer unit in accordance with claim 1, wherein the airflow channels (24, 34) each have an inlet and an outlet which are arranged such that the airflow takes place through the inlets (20, 30) and through the outlets (22, 32) in parallel.

7. The refrigerator unit and/or freezer unit in accordance with claim 6, wherein the inlets (20, 30) and outlets (22, 32) are arranged such that the airflow from the inlets (20, 30) to the outlets (22, 32) sweeps over an angular region of 180°.

8. The refrigerator unit and/or freezer unit in accordance with claim 7, wherein the inlets (20, 30) and outlets (22, 32) are arranged such that the airflow over compressor (5, 6) takes place on an outer path and the airflow over the condenser (2) takes place on an inner path.

9. The refrigerator unit and/or freezer unit in accordance with claim 1, wherein the bypass passage (9) has an actuator for throughput setting.

10. The refrigerator unit and/or freezer unit in accordance with claim 2, wherein the fan (3), the compressor (5, 6) and the condenser (2) are arranged as base assemblies or as top assemblies.

11. The refrigerator unit and/or freezer unit in accordance with claim 10, wherein one or more filters (4) are provided in front of the fan (3).

12. The refrigerator unit and/or freezer unit in accordance with claim 3, wherein one or more filters (4) are provided in front of the fan (3).

13. The refrigerator unit and/or freezer unit in accordance with claim 2, wherein one or more filters (4) are provided in front of the fan (3).

14. The refrigerator unit and/or freezer unit in accordance with claim 1, wherein fan (3) is arranged such that it applies air entering the respective channels from the same direction to the compressor (5, 6) and condenser (2).

* * * * *